United States Patent [19]

Maag et al.

[11] 4,164,837

[45] Aug. 21, 1979

[54] METHOD OF FORMING A WRAPPED YARN

[75] Inventors: Fritjof Maag, Kelkheim; Friedrich Unger, Lorsbach, both of Fed. Rep. of Germany

[73] Assignee: Hoechst Aktiengesellschaft, Frankfurt am Main, Fed. Rep. of Germany

[21] Appl. No.: 752,436

[22] Filed: Dec. 20, 1976

Related U.S. Application Data

[62] Division of Ser. No. 585,607, Jun. 10, 1975, Pat. No. 4,018,042.

[30] Foreign Application Priority Data

Jun. 12, 1974 [DE] Fed. Rep. of Germany ..... 2428483

[51] Int. Cl.[2] ..... D02G 3/38; D02G 3/02

[52] U.S. Cl. ..... 57/3; 57/18

[58] Field of Search ..... 57/3, 6, 18, 34 R, 36, 57/140 R, 144, 149, 152, 153

[56] References Cited

U.S. PATENT DOCUMENTS

| | | | |
|---|---|---|---|
| 3,328,946 | 7/1967 | Schumann et al. | 57/160 X |
| 3,438,193 | 4/1969 | Kosaka et al. | 57/144 |
| 3,577,718 | 5/1971 | Purcell | 57/160 X |
| 3,643,416 | 2/1972 | Andrews et al. | 57/144 X |
| 3,717,959 | 2/1973 | Chatin | 57/160 |
| 3,769,787 | 11/1973 | Rosenstein et al. | 57/144 |
| 3,831,369 | 8/1974 | Northup et al. | 57/144 |

FOREIGN PATENT DOCUMENTS

| | | | |
|---|---|---|---|
| 1270065 | 2/1962 | France | 57/18 |
| 1455498 | 9/1966 | France | 57/18 |

*Primary Examiner*—Donald Watkins

*Attorney, Agent, or Firm*—Curtis, Morris & Safford

[57] ABSTRACT

A yarn is described composed of an untwisted staple sliver and of at least one filament wound around this sliver.

The denier of the winding filamentary yarn is under 50 dtex, the elongation at break of the winding filamentary yarn is at least as great as the elongation at break of the staple fibers; the strength at a specific load of the winding filamentary yarn at 4% of elongation is at least 10 g. Moreover, the shrinkage factor of the winding filamentary yarn is within the same range as the shrinkage factor of the staple fibers. Also at least 85% of the staple fibers are longitudinally orientated in the sense of the yarn direction.

Furthermore, a process is described for the manufacture of a wrapped yarn by wrapping at least one filamentary yarn around stretched, highly oriented staple fibers being led through the hollow shaft of a rotating filamentary yarn bobbin. The winding filamentary yarn is withdrawn from the filamentary yarn bobbin and also led through the hollow shaft of this filamentary yarn bobbin. During this processing step and after having stretched the staple sliver, a filament of denier 1–50 dtex, the tension of which is at most 5 g, is wrapped around the staple sliver.

9 Claims, 4 Drawing Figures

METHOD OF FORMING A WRAPPED YARNThis is a division, of application Ser. No. 585,607 filed June 10, 1975 now U.S. Pat. No. 4,018,042.

The invention is related to a yarn consisting of an untwisted sliver and of at least one filamentary yarn wrapped around this sliver, as well as to a process for the manufacture of this wrapped yarn.

Strength and resistance to mechanical stress are imparted to conventionally constructed staple fiber yarns by twisting the individual staple fibers together to a lower or higher extent.

The disadvantages of this fiber construction comprise the relatively low exploitation of the strength of the fiber substance in the staple fiber yarn, namely only about 50% the looping tendency of the yarn at a low tension due to the degree of the imparted twist, the curling tendency of single-face knits, and the damage done to the staple fiber yarn itself by the mechanical stress during the twisting operation.

There are also known staple fiber yarns and processes for their manufacture which achieve the desired strength and further processability either without or with little twisting of the staple fibers with respect to one another, by combining the untwisted roving with yarns or filaments.

This combination of untwisted roving and the yarn or the filament is generally achieved in such a way that the material imparting strength is wrapped around the non-twisted or slightly twisted slivers so that these slivers are protected against mechanical damage.

U.S. Pat. No. 1,732,592 describes a machine for the manufacture of composite yarns, in which staple slivers e.g. of asbestos and cotton are wrapped in one or several filaments and which finally imparts a twist to the yarn.

U.S. Pat. No. 1,874,502 is related to a device for wrapping yarns which may be composed of horsehair and cotton rovings which are helically wrapped in silk or artifical silk.

U.S. Pat. No. 2,449,595 mentioned warp filaments of relatively large diameter, which are composed of loosely connected staple fibers such as rovings of cotton, wool, nylon or rayon, which are bundled together by one or several filaments placed helically.

The British Pat. No. 572,244 claims a device for the manufacture of doubled yarns with which a tighter twist of a staple fiber roving is produced by the feed rolls of a spinning frame and the roving is then wrapped helically or doubled with another staple fiber yarn or with a filamentary yarn.

U.S. Pat. No. 3,328,946 also describes a corkscrew-type, coiled yarn composed of a staple fiber roving helically wrapped in a filament.

Yarns such as those described by the aforementioned printed publications have the disadvantage that the tensile strength of the untwisted staple fibers makes only a partial contribution to the strength of the composite yarn. Also the high proportion of the wrapping component often affects undesirably the appearance of such yarns. Furthermore, the large proportion of expensive wrapping material raises the costs beyond an economically reasonable level.

British Pat. No. 1,163,523 describes a doubled yarn composed of staple fibers which have a total denier of 555 dtex and which are wrapped helically with a filamentary yarn having a total denier of 111 dtex.

German "Offenlegungsschrift" 1,685,881 describes a yarn having a comparatively low proportion of filamentary yarn, the manufacture of which is carried out in such a way that first a falst twist is imparted to a staple sliver, which is then wrapped in a winding thread and finally twisted back to the initial position. However, due to the special construction of the yarn, a large part of the strength of the yarn depends on the strength of the filamentary portion. Therefore, yarns having a strength sufficient for processing and having characteristics which satisfy the corresponding requirements may be obtained only in case of comparatively coarse yarns. This fact is responsible for the fact that such yarns have been used in the past, if at all, for very special purposes only.

The principal object of the present invention is to provide a yarn which does not have the aforementioned disadvantages of the twisted yarns and which avoids as well the disadvantages of the aforecited wrapping methods for the manufacture of yarns from untwisted slivers.

The solution has been found surprisingly in a yarn showing the following differences as compared to conventional wrapped yarns:

(a) the denier of the wrapping filamentary yarn is less than 50 dtex, preferably less than 15 dtex, and (b) the elongation at break of the filamentary wrapping yarn is at least as great as the elongation at break of the staple fibers, and (c) the stress/strain relationship of the filamentary wrapping yarn is such that a force of at least 10 grams is required to produce a 4% elongation, and (d) the shrinkage of the wrapping filamentary yarn is within the same range as the shrinkage of the staple fibers, and, (e) at least 85% of the staple fibers are oriented longitudinally in the yarn direction.

The untwisted sliver consists preferably of a mixture of staple fibers. Another preferred embodiment employs a wrapping filamentary yarn having an elongation at break which is at least as great as the lowest occurring elongation of the staple fiber component. Particularly desirable are yarns made according to the invention in which the wrapping filamentary yarn has a shrinkage within the same range as the shrinkage of the staple fibers with the highest shrinkage factor.

Under stress of the yarn up to the breakage point the staple fibers from the untwisted staple sliver break first preferably, whilst the winding filamentary yarn breaks later.

The yarns according to the invention are particularly advantageous in cases where the winding filamentary yarn consists of a monofilament, preferably not submitted to delustering. It is also possible for the untwisted staple sliver to be wrapped in two filamentary yarns in opposite directions. Moreover, the winding filamentary yarn may consist of a substance which can be removed after further processing from the product of a supplementary treatment of the yarn.

The average staple fiber length of the untwisted staple sliver should preferably vary from 40–160 mm, even more favorably from 60–120, or be optimally set at least 80 mm. Especially favorable results are obtained with the yarns according to the invention, if the components of the staple fiber mixture have different shrinkage factors. The use of multicomponent-staple fibers as untwisted staple sliver is particularly advantageous, the multicomponent-staple fibers being crimpable by means of a supplementary treatment.

The yarns according to the invention are manufactured according to a process which has been contrived especially for this purpose for the manufacture of a wrapped yarn by means of wrapping at least one filamentary yarn about drawn, highly oriented staple fibers, which are led through the hollow shaft of a rotating filamentary yarn bobbin, the filamentary yarn unwinds from the filamentary yarn bobbin and is also led through the hollow shaft of the filamentary yarn bobbin. The characteristic feature of this process is the fact that after having drawn the staple sliver, a filament of a denier of from 1–50 dtex, preferably from 1–15 dtex, is would thereabout with tension of the filament of at most 5 g, preferably a maximum of 1 g,.

The filament preferably bobbin including the filaments has a maximum weight of 250 g, especially of from 50–150 g. The filament bobbin rotates at a rate of at least 20,000 revolutions per minute, preferably from 50,000 to 150,000 r/min. The thread loop which would form during the unwinding of the filament from the filament bobbin, is advantageously avoided by means of a co-rotating cylindrical loop limiting device that encases the bobbin. The same desirable effect, is also obtained by using internally wound filament bobbins. When being wrapped the yarn should have a tension of ten times to hundred times the filament tension. A special embodiment of the process according to the invention consists in having different shrinkage factors for the drawn, highly oriented staple fibers, this shrinkage being initiated after the wrapping operation, but prior to winding up the wrapped yarn. Furthermore, the wrapped yarn may be submitted to a fixing process prior to being wound it may also be passed through a paraffinizing device. Specific embodiments use a multifilament or a monofilament as a wrapping filament.

The invention is based on the concept that a yarn composed of a comparatively very fine filamentary yarn wrapped around an untwisted staple sliver, is so constructed that an increasing tensile stress induces the winding filamentary yarn to squeeze the wrapped sliver more and more, so that the friction between the fibers increases to such an extent that the individual fibers cannot slide relative to one another under the existing tensile stress, the total tensile stress has therefore to be absorbed by the individual fibers which finally break prior to the filamentary winding yarn being strained to the breaking point.

Staple fibers are of natural origin or are obtained by converting or cutting continuous fibers. Filamentary yarns are continuous fibers, they are sometimes also called endless threads. In the context of the present invention the definition of "filamentary yarn" also stands for monofilaments, i.e. filaments composed of one single filament and not consisting of several filaments (multifilament).

The yarn according to the invention consists of an untwisted staple sliver and of at least one filamentary yarn wrapped around this staple sliver.

The denier of the winding filamentary yarn is kept as fine as possible. Its lower limit is determined by the difficulty of producing and handling very fine filamentary yarns. The lower limit of the denier for the winding filament is about 1, preferably about 5 dtex. As far as the coarseness is concerned, the denier is limited by the appearance or the characteristics of the yarn and, first of all, also by the production costs for the yarn. Therefore, the denier has to be finer than 50 dtex in any case, preferably finer than 15 dtex.

Practice has shown that even with proportions of the winding filamentary yarn of less than 1% of the total yarn, yarns may be manufactured by the present process having staple fibers of the staple sliver which, when subjected to a tensile stress, break before the winding filamentary yarn breaks. This fact permits improvement in the utilization of the fiber strength within the composite yarn by about 20% in comparison to conventionally spun yarns, if at the same time fibers are used which have normal adhesive qualities. To obtain these yarn qualities the following construction characteristics are required:

The strength-strain-characteristics of the staple fibers in the untwisted sliver and those of the winding filament have to be adjusted properly. The elongation at break of the winding filamentary yarn being equal or higher than that of the staple fibers proved to be most useful. The elongation at break of the staple fibers and of the filamentary yarns respectively has to be examined at identical initial clamp-in lengths because of its influence of the clamp in length on the results of the measurement.

An advantageous embodiment of the invention is one in which the initial modulus of the winding filamentary yarn is large, so that in the case of stretching stress a sufficiently high tension may be built up quickly in the filamentary yarn in order to achieve a good adhesion of the fibers of the untwisted sliver even under minor traction in the yarn. Therefore, the stress required to produce an elongation of 9% in the winding filamentary yarn has to be least 10 g at an elongation of 4%. Due to the fine denier and the fast increasing tension of the winding filament it is possible, for one thing, to keep extremely low the percentage of the winding filament, so that the properties of the filament have little influence on the characteristics of the yarn, but that the properties of the staple fibers are fully prevailing; on the other hand, the yarn according to the invention is able to resist an alternating tensile strain such as is applied e.g. to warp yarns on the loom or on warp knitting machines.

The shrinkage of the winding filamentary yarn has to correspond as far as possible to the shrinkage of the fibers, so that upon subsequent heat treatment or wet treatment any undesirable effects may be avoided and the yarn may remain as smooth as possible. If staple fiber mixtures are used for the yarn, the shrinkage factor of the winding filamentary yarn is related to the average shrinkage factor of the fiber component with the highest shrinkage. The shrinkage of the filamentary yarn must not differ by more than 10%, preferably by not more than 5% from the average shrinkage of the fibers or of the fibers with highest shrinkage, if fiber mixtures are used.

The shrinkage is determined as follows:

Prior to the shrinkage treatment the length $l_0$ of the staple fibers or of the filaments is determined exactly. Subsequently, the staple fibers or the filaments are kept for 5 minutes in a shelf dryer which had been preheated to the measuring temperature. Finally the length $l_1$ of the staple fibers is determined (after the shrinking operation). The shrinkage factor S results from the formula $$S=(l_1-l_0)/l_0\cdot 100\%.$$

The shrinkage of the staple fiber to be wrapped as well as that of the winding filament is measured under the same conditions which prevail for further processing the winding yarn; in the case of polyethylene terephthalate this means e.g. a temperature of about 190° C., in the case of polyamide-6 and polyamide-6.6 about 190° C. and in the case of polyacrylonitrile a temperature of up to about 120° C.

The degree of longitudinal orientation of the staple fibers in the staple sliver has to surpass a certain minimum value. The contact of the individual fibers in slivers composed of parallel, well oriented staple fibers is closer than the contact in slivers with poor orientation of the fibers. Furthermore, parallelly oriented fibers are loaded faster and more uniformly by a tensile strain on the yarn. Tests have shown that the degree of longitudinal orientation of the fibers in the sliver has to be high, so that a high strength of the yarn is achieved even for fine deniers of the winding filament. At least 85%, preferably more than 90% of the fibers in the sliver have to be oriented longitudinally.

The degree of orientation of the staple fibers in the staple sliver is measured as follows:

A piece having the length $l_S = 0.4 \times$ average staple is cut out of the staple sliver.

The lengths of the individual staple fibers ($l_F$) of the cut-out piece are examined and classified in 2 groups:

Group 1: $l_F > l_S$

Group 2: $l_F \leq l_S$

The ratio of the number of staple fibers in group 1 ($Z_1$) to the total number of the counted staple fibers (Z) represents a measuring standard for the orientation (O) of the staple fibers in the staple sliver.

The orientation O is given by $$0 = (l - (Z_l)/Z) \times 100\%$$

The force at a specific load is the force needed to achieve an elongation of 4%, measured at 20° C. and 65% of relative atmospheric humidity (see stress—strain—curve according to German Industrial Standard DIN 53 815).

The elongation at break is the ratio of the increase in length at the breaking point to the initial length of the measuring test specimen (DIN 53 815, par. 8).

When manufacturing the yarn according to the invention, the tension of the winding filamentary yarn at the winding point and the withdrawal tension of the finished wrapped yarn have to be adjusted with great care, so that the yarn has a sufficient stability even without a tensile strain. At the moment of the winding operation, the yarn tension must not be less than ten times and not more than one hundred times the monofilament tension.

The winding tension must not be too high, otherwise the winding thread approaches too close to the core of the yarn and the yarn acquires an appearance similar to that of a cork-screw.

Moreover, when submitting the yarn to an elongation strain, the winding thread imbedded in the composition as a relatively extended drawn component has to resist excessive stress and breaks prior to the stress on the individual staple fibers in the staple slivers reaches the breaking point.

The tension of the winding filamentary yarn is adjusted as follows:

The wind-up filament is led to the winding device 6 from the bobbin through its hollow shaft. The staple sliver which is to be wrapped is during this adjustment removed. The revolutions of the bobbin with the winding filament and the withdrawal speed are adjusted to the desired values. Now the tension of the yarn between the hollow shaft and the wind-up device is measured.

The required number of revolutions/m of yarn primarily depends on the denier of the yarn—similar to conventional staple fiber yarns. Therefore, it is also useful to operate with the definition of the twist coefficient $$\alpha = (T/m\sqrt{dtex}/100$$

for the novel yarn, T/m representing the number of revolutions per meter and *dtex* representing the denier of the total yarn.

The length of the staple fibers in the untwisted staple sliver is also of fundamental importance. The effect is such that yarns made of staple fibers with greater staple fiber length may be manufactured with a lower twist coefficient (compare example 1). The interdependency is more evident for the yarns of the invention than for yarns of conventional spinning methods. A twist coefficient of $\alpha = 100$ is generally sufficient to give a satisfactory staple fiber adhesion. If staple fibers with a particular staple length are used, such as can be manufactured for example according to the two-breaking-process, the twist coefficient may be reduced to $\alpha 60$.

Experience has shown that the mere reduction of the number of turns per meter of a yarn constructed according to the invention at first results in a slight decrease of the yarn strength only, but that all the rest of the characteristics remain unaffected.

In comparison to conventionally spun staple fiber yarns this processing method permits the strength of these conventional yarns to be achieved with about 20% less turns (cf. example 1). It may happen thereby that prior to the break of the first individual staple fiber the winding filament may break, so that the fibers fluff out. But for many application purposes this does not matter.

In certain cases, for example for sewing threads which are subject to heavy mechanical stress it might be advantageous to have the staple sliver enwrapped not just by a single filament yarn, but by two of them wound in opposite directions. Though the proportion of filament yarns increases in such cases, the stability of the composite yarn increases also and the production speed can be more than doubled at a predetermined number of turns per minute of the spindle.

If the winding filamentary yarn is a non-delustered monofilament yarn that is as transparent as possible, a special coloring operation of the winding filament can be dispensed with in the case of colored yarns or of colored surfaces if its proportion relating to a colored yarn is small.

A yarn of such a construction offers the advantages not only of a comparably high strength, but also of doing no harm to the fibers during manufacture, thus permitting processing without problems encountered highly sensitive staple fibers, such as low-pilling polyester types. Another advantage is that said yarns are not subject to damage due to separation of individual staple fibers from the composite staple fibers and the curling back or folding back of these individual staple fibers upon winding them on a bobbin or during other processing steps for further of the yarn. The yarns have no tendency whatsoever to overtwist. This yarn construction is most suitable to the development of low-cost processes for the manufacture of yarns, since the mass of the rotative parts can be kept relatively low due to the low proportion of the winding filamentary yarn and despite the high botton weights attainable. Therefore, the manufacturing operations can be carried out with a high number of revolutions, which permit also high production speeds.

The special features of the novel yarn, namely little lint, no fiber detachment and folding back, no overtwist-permit e.g. the trouble-free use of warp and also single yarns for weaving purposes without any sizing operations. Single yarns may be used as well for single-face knits without being afraid of a curling reaction of the material. The increased strength and the low elongation rate of such yarns as well as their nontorque quality permit their especially advantageous use as single yarns for the manufacture of sewing threads. There is still to be mentioned the possible use for warp knitting purposes, whereby their low stuffing tendency brings about favorable results.

The yarn construction as described is especially appropriate for the manufacture of yarns with special characteristics. The untwisted staple sliver may, for example, be composed of staple fibers having different shrinkage properties. If the shrinkage treatment is carried out later in the yarn or in the woven structure, the higher shrinking staple fibers form the core of the yarn, whilst the staple fibers with the lower shrinkage data fluff out arcuately. An especially voluminous yarn is obtained in that way. Since the yarn construction is much more open, the bulk effect is larger than that of conventional yarns made of staple fibers having similarly different shrinkage properties.

If the shrinkage of the winding filamentary yarn approximately corresponds to that of the higher shrinking staple fiber portion, a good yarn strength and good processing properties are also obtained with single yarns.

When the yarns are processed into woven fabrics or knits the individual staple fibers of the untwisted staple sliver cling so well to each other that the filamentary winding yarn may even be removed without endangering the adhesion of the textile material.

The winding filamentary yarn is composed of fiber-forming high-molecular polymers, preferably or polyester or polyamide. Poly-m-phenylene-isophthalate or similar heat-resistant polymers may preferably be used for the manufacture of sewing threads. For the manufacture of yarns the winding filaments of which may be removed there can be taken into consideration e.g. preferably a water-soluble PVA-filamentary yarn.

The untwisted staple sliver may be composed of natural or synthetic fibers or mixtures thereof. Short-staple cotton may be included as well as synthetic fibers having particularly long staple. Other natural fibers, such as wool, may also be used, besides cotton. Suitable synthetic fibers are fibers made of polyester, preferably of polyethylene terephthalate, polyacrylonitrile and copolymers thereof, polyamides, such as polyamide and polyamide-6.6, polyolefins such as polypropylene and polyethylene, viscose staple fiber etc. Further suitable materials are multicomponent fibers composed of at least two chemically or physically differing components and crimpable by a supplementary treatment. Especially advantageous are staple fibers having staple lengths of 80 mm and more, since they require less twist of the filamentary winding yarn and since the yarn appears even more voluminous.

When comparing example 7 with example 4, it is evident that an elongation at break of the winding filamentary yarn which is less than the elongation at break of the staple fibers affects detrimentally the strength and the elongation at break of the yarn.

The yarn according to example 8 has been worked up to a woven fabric and subsequently submitted to normal finish. The different shrinkage of the two components results in a crepe-type surface, whilst a woven fabric made of yarns according to example 1 displays a perfectly smooth surface.

In some cases the crepe-like appearance may be desirable, but normally this effect is considered undesirable.

Example 3 indicates that a lower force at an elongation of 4% also results in a lower effectivity of the substance.

The yarn as per example 9 was manufactured according to the process for obtaining carded yarn. Therefore, the degree of orientation is markedly lower than that observed for the yarn made of the same fibers as per example 1. Also the extent to which the sum of the strengths of the individual fibers is utilized in the thus corded yarn is strikingly lower.

the yarn of the invention is manufactured according to a process especially contrived for this purpose. The yarn satisfies the requirements only, if the manufacture is carried out as follows: The roving which had been prepared in a preparatory spinning process, is refined to the desired thickness of yarn by means of a drafting process. The individual staple fibers (filaments) are thereby oriented to a high extent. A monofilament as fine as possible is wound around the sliver made of parallel staple fibers as close as possible to the clamps of the feeding rolls, preferably at a point closer than half the staple length.

During this operation the tension of the winding thread must not surpass 5 g, preferably 1 g. Due to the fineness of the winding thread it is possible to the same at a sufficient running length on a relatively small bobbin having a weight of no more than 200 g.

This small bobbin also permits the attainment of a very high number of turns of approximately 100,000 R.P.M. At this high rotational speed the winding filament balloons outwardly under the influence of centrifugal force to build up an intolerably high tension in the filament. It is therefore necessary to prevent the thread ballooning.

The usual stationary balloon limiting device is not suitable due to the high speed of rotation of the ballooned filament and due to the high friction between the ballooned filament and the stationary balloon-limiting device. Therefore a cylinder is used as balloon limiting device which is fixed to the bobbin and follows its rotating movement.

Another possibility is the use of a bobbin wound from the inside by means of centrifugal forces, this method naturally prevents the formation of any balloon.

The staple sliver to be wrapped with the filament is led through a tube in the hollow shaft of the filamentary yarn bobbin carrying the winding yarn. The tube either rotates simultaneously or may be set up stationary. The wrapped sliver is withdrawn from the tube by feed rolls. The axis of the tube should point tangentially to the nip of the feed rolls.

The ratio of the circumferential speed of the feed rolls of the stretching device to that of the feeding device after the winding operation has to be adjusted in such a way that at the moment of the winding operation the tension of the yarn has to be at least ten times, but not more than one hundred times the tension of the monofilament tension.

After the feed rolls the finished yarn is wound on a cross wound bobbin which may be cylindrical, conical or biconical.

The most useful device to start spinning is a compressed air pistol, for example according to Austrian Pat. No. 269,701. A vacuum is produced inside the tube which is situated in the center of the filamentary yarn bobbin, so that the sliver is sucked in this tube. The sliver is thereby wrapped with the monofilament and strengthened to such an extent that it is possible to lead the yarn through the feed rolls and spread it on the bobbin.

Due to the high winding yarn feeding speeds of this process, the process offers economically interesting possibilities for the combination of supplementary treatment steps which had to be carried out hitherto in separate processes.

Such supplementary treatment processes may include: The shrinkage of bulk yarn, a shrinkage reduction of the yarns by heat-setting, paraffinizing knit yarns, etc.

Said processes permit the manufacture of yarns having a strength 20% higher than that of conventionally spun yarns, at speeds about ten times higher than those of conventional processes. Nevertheless, the processing conditions for the fibers are so mild while they undergo the yarn manufacturing process that they are practically not subject to any stress, so that the quality of the yarn obtained is exceptionally good and very regular.

The following examples and drawings illustrate the invention:

EXAMPLES

Figure 1:
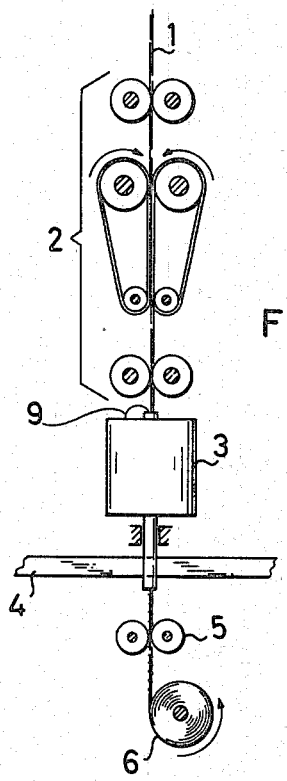
FIG. 1 diagrammatically shows a device for forming the yarn claimed.
Figure 2:
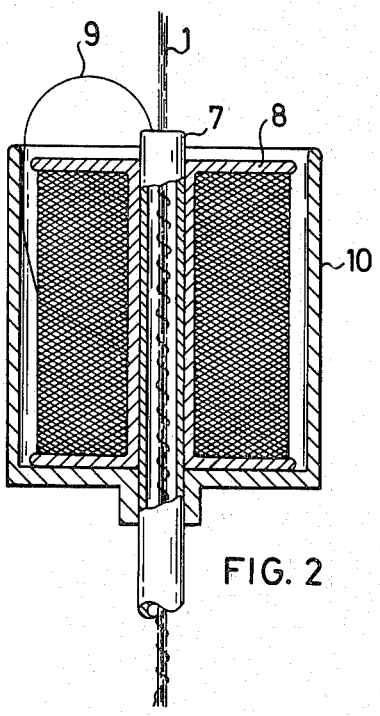
FIGS. 2 and 3 show devices for wrapping yarn about a roving.
Figure 3:
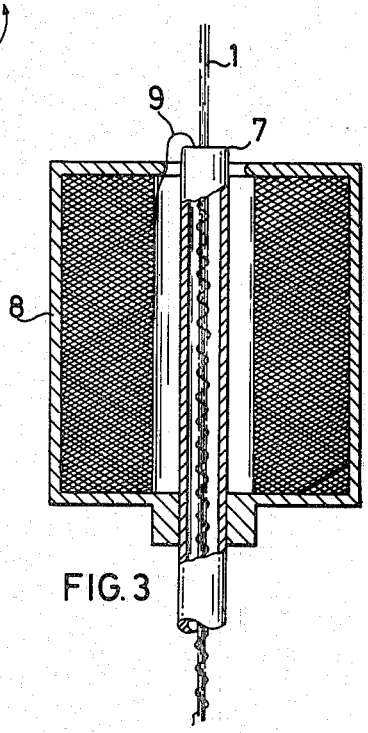

Various yarns were manufactured by means of the device shown diagrammatically in FIG. 1. (1) is the fed-in roving, (2) is a double-belt drawing system, (3) is an enwrapping device the details of which are shown in FIGS. 2 and 3, (4) represents a tangential belt, (5) are feed rolls and (6) is the winding bobbin. The FIGS. 2 and 3 show specifically the enwrapping device (3). The fed-in roving (1) is led through a tube (7) inside the hollow shaft of the bobbin (8), on which the yarn (9) is wound. At the same winding speed of rotation as bobbin (8) there is rotated simultaneously a balloon limiting device (10).

Another possible embodiment of the enwrapping device, which has not been used however in the examples described, is represented in FIG. 3. The bobbin (8) is internally wound with the winding yarn (9). The winding yarn (9) is led through a tube (7) inside the hollow shaft of the bobbin (8) and wraps around the roving (1) which also passes therethrough.

The length L of the bobbin (8) is 50 mm for all examples, its diameter D being 40 mm. The wound bobbin (8) weighed 100 g. It rotates at 48,000 revolutions per minute.

EXAMPLE 1

A roving having a denier of 10,000 dtex made of staple fibers of modified polyethylene terephthalate according to example 1 of German "Auslegeschrift" 1,720,647, filament denier 3.3 dtex, staple length 60 mm, strength of the individual staple fibers 29 g/tex, elongation at break 35% and shrinkage at 200° C. being 6% - was introduced as roving (1) into the device shown in FIG. 1.

The filamentary winding yarn (9) had the following properties:

material:
nylon 6.6
15 dtex
strength 57 g/tex
elongation at break 44%
shrinkage at 200° C.=8%
strength at a specific load at 4% elongation: 20 g

| | 48 000 revolutions per minute of the bobbin (8) result in wrapped yarn with the following properties: | | | | | | | |
|---|---|---|---|---|---|---|---|---|
| Denier dtex | coils per m | twist coefficient α | degree of orientation of the staple fibers | max. force g | strength g/tex | elongation % | effectivity of the substance % | output m/min |
| 275 | 930 | 154 | 98 | 523 | 19.0 | 10.3 | 66 | 51.6 |
| | 800 | 133 | 95 | 498 | 18.1 | 10.0 | 62 | 60.0 |
| | 670 | 111 | 96 | 483 | 17.6 | 9.5 | 60 | 71.6 |
| | 530 | 88 | 99 | 432 | 15.7 | 7.9 | 54 | 90.6 |

The "maximum force" is determined herein according to German Industrial Standard 53 815.
The column "Out-Put indicates the speed at which the finished wrapped yarn is wound on the bobbin.
The effectivity of the substance means herein the ratio of $$\frac{\text{Wrapped yarn strength [g/tex]}}{\text{Total staple fiber strength [g/tex]}} \times 100\%$$

EXAMPLE 2

Staple fibers used:
polyethylene terephthalate according to example 1 of German "Auslegeschrift" 1,720,647
filament denier 3.6 dtex
tearing tow
average staple 150 mm
strength 31 g/tex
elongation at break 15%
shrinkage at 200° C.=7.5%, made of tearing tow.
Filamentary winding yarn:
nylon 6.6
15 dtex
strength 57 g/tex elongation at break 44%
shrinkage at 200° C.=8%
strength at a specific load at 4% elongation: 20 g

| Wrapped yarns obtained: | | | | | | | | |
|---|---|---|---|---|---|---|---|---|
| Denier dtex | coils per m | α | degree of orientation | max. force g | strength g/tex | elongation % | effectivity of the substance % | out-put m/min |
| 275 | 600 | 100 | 97 | 571 | 20,8 | 4,7 | 67 | 80 |
| | 500 | 83 | 100 | 546 | 19,9 | 4,6 | 64 | 96 |
| | 400 | 66 | 99 | 488 | 17,7 | 4,5 | 57 | 120 |
| | 300 | 50 | 98 | 373 | 13,6 | 4,3 | 44 | 160 |

Figure 4:
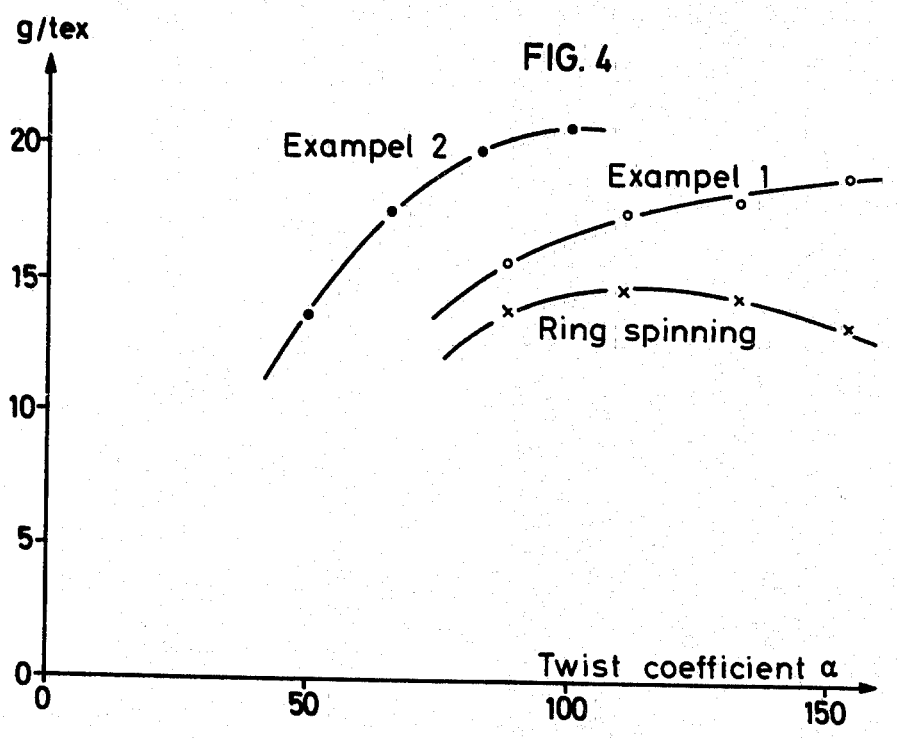
FIG. 4 shows the relationship between strength of wrapped yarns and the twist coefficient.

FIG. 4 shows that the strength of the wrapped yarn according to the examples 1 and 2 and of yarns produced of staple fibers as per the ring spinning process depends on the twist coefficient (α).

The yarns as per the invention are obviously superior to the yarns of conventional manufacture.

EXAMPLE 3

As staple fibers were used those of example 1, however differing in that they shrink at 200° C. to the extent of 6.0%. The yarn had a denier of 275 dtex and a twist coefficient of (α)=130.

The details are specified as follows:

Fiber used:
low-pilling polyester fiber
3.3 dtex/60 mm
strength 29 g/tex
elongation at break 35%
heat shrinkage 6.0%
at 200° C.

| winding filament: | | | | | |
|---|---|---|---|---|---|
| material | fineness dtex | strength g/tex | elongation % | heat shrinkage % | strength at a specific load at 4% elongation g |
| Polyethylenetere-phthalate-mono-filament | 10 | 55 | 38 | 12 | 22 |
| | 7 | 50 | 55 | 9 | 17 |
| | 4 | 48 | 46 | 12 | 10 |

| yarn data: | | | | | | |
|---|---|---|---|---|---|---|
| denier dtex | α | maximum force g | strength g/tex | elongation % | effectivity of the substance % | out-put m/min |
| 275 | 130 | 435 | 15.8 | 9.5 | 54 | 61.3 |
| | | 493 | 17.9 | 12.7 | 62 | |
| | | 439 | 16.0 | 11.5 | 55 | |

EXAMPLE 4

Fiber used:
polyethylene terephthalate according to example 1 of German "Auslegeschrift" 1,720,647
1.7 dtex/38 mm
strength 32 g/tex
elongation at break 40%
shrinkage at 200° C.=7%
Winding filament:
nylon 6.6
15 dtex
strength 57 g/tex
elongation at break 44%
heat-shrinkage at 200° C.=8%
strength at a specific load at 4% elongation=20 g

| Yarn data: | | | | | | |
|---|---|---|---|---|---|---|
| Fineness dtex | α | maximum force g | strength g/tex | elongation at break % | effectivity of the substance % | out-put m/min |
| 275 | 120 | 530 | 19.3 | 10.8 | 60 | 66.4 |

EXAMPLE 5

Fiber used:
Polyacrylonitrile 1.4 dtex/40 mm
Strength 34 g/tex
Elongation at break 23%
Heat shrinkage 1.7%
Winding filament:
nylon 6.6
15 dtex
strength 57 g/tex
elongation at break 44%
heat shrinkage 5.5%

| Yarn data: | | | | | | |
|---|---|---|---|---|---|---|
| fineness dtex | α | max. force g | strength g/tex | elongation at break % | effectivity of the substance % | m/min. |
| 275 | 120 | 548 | 19.9 | 9.2 | 59 | 66.4 |

EXAMPLE 6

Fiber used
Combed pure wool
Winding filament
nylon 6.6
15 dtex

| Yarn dta | | | | | | |
|---|---|---|---|---|---|---|
| Fineness dtex | α | max. force g | strength g/tex | elongation at break % | effectivity of the substance % | out-put L |
| 250 | 62 | 165 | 6.6 | 13.2 | 41 | 122.5 |
| | 70 | 179 | 7.2 | 12.4 | 45 | 108.4 |
| | 78 | 208 | 8.3 | 13.0 | 52 | 97.2 |
| | 93 | 221 | 8.8 | 14.7 | 55 | 81.5 |

Comparison with conventionally spun combed yarn made of the same roving:

| | | | | |
|---|---|---|---|---|
| 250 | 166 | 6.6 | 11.1 | 41 |

As far as wool is concerned, the determination of the fiber shrinkage is not a common practice, since the poor shrinkage power of the wool does not establish a relation between the fiber shrinkage and the yarn shrinkage.

When wool is used as staple fiber component, the only possible test method is to submit the woven surface made of the finished wrapped yarn to a test after the completion of its finishing, in order to determine in such a way whether the shrinkage values of the staple fiber component and of the winding filamentary yarn are sufficiently adjusted to each other.

EXAMPLE 7

Fiber used
polyester fiber according to example 1
1.7 dtex/38 mm
strength 32 g/tex
elongation at break 40%
heat shrinkage at 200° C.=5.7%
Winding filament
polyethylene terephthalate monofilament
10 dtex
strength 55 g/tex
elongation at break 38%
heat shrinkage 12%
Force at 4% elongation=22 g Yarn data:

| Fineness dtex | α | max. force g | strength g/tex | elongation at break % | effectivity of the substance % | out-put m/min. |
|---|---|---|---|---|---|---|
| 275 | 120 | 485 | 17.6 | 9.5 | 55 | 66.4 |

EXAMPLE 8

Fiber used
polyethylene therephthalate according to example 1 of German "Auslegeschrifit" 1,720,647
3.3 dtex/60 mm
strength 29 g/tex
elongation at break 35%
heat shrinkage 0.7%
Winding filament
nylon 6.6
15 dtex
strength 59 g/tex
elongation at break 40%
heat shrinkage 10.9%
force at 4% elongation=20 g Yarn data

| fineness dtex | α | max. force g | strength g/tex | elongation at break % | effectivity of the substance % | out-put m/min |
|---|---|---|---|---|---|---|
| 275 | 130 | 491 | 17.9 | 10.1 | 62 | 61.3 |

When a woven fabric is made of this yarn and boiled during a washing process, a distinctly crepe-like appearance is obtained which results from a higher shrinkage of the winding filament.

EXAMPLE 9

Fiber used
polyester fiber according to example 1
3.3 dtex/50 mm
strength 29 g/tex
elongation at break 35%
heat shrinkage 0.8%
Winding filament
nylon 6.6
15 dtex
strength 57 g/tex
elongation at break 44%
heat shrinkage 5.5%
force at 4% elongation 22 g Yarn data

| fineness dtex | α | degree of orientation % | max. force g | strength g/tex | elongation at break % | effectivity of the substance % | out-put m/min. |
|---|---|---|---|---|---|---|---|
| 1400 | 100 | 66 | 286 | 2.0 | 143 | 7 | 90 |

What is claimed is:

1. A process for the manufacture of a wrapped yarn of the type in which a bundle of staple fibers is passed through the hollow shaft of a rotating bobbin carrying a filamentary yarn and the yarn is withdrawn from the bobbin and led to the longitudinally moving fiber bundle, whereby rotation of the bobbin causes the fiber bundle to be wrapped with the filamentary yarn in a helical configuration, said process comprising the steps of winding said fiber bundle with a filamentary yarn having (a) a denier of 1 to 50 dtex, (b) an elongation at break greater than the elongation at break of the fibers of said bundle, whereby when the yarn is stretched the winding yarn does not break until after the core fibers break and (c) a modulus such that a force of at least 10 grams is required to produce an elongation of 4% and maintaining a tension of no more than 5 grams on said winding yarn during said winding operation, whereby the core fibers are rapidly squeezed together by the winding yarn when wrapped yarn is stretched.

2. A process according to claim 1 wherein the tension of the wrapped yarn during winding is from 10 to 100 times the tension of the winding filament.

3. A process according to claim 1 wherein the staple fibers of the fiber bundle have different shrinking properties and shrinkage is initiated after the winding operation but prior to spooling of the yarn.

4. A process according to claim 1 that includes the additional step of heat setting the wrapped yarn before it is spooled.

5. A process according to claim 1 that includes the additional step of paraffinizing the wrapped yarn before it is spooled.

6. A process according to claim 1 wherein the winding filament is a multi-filament.

7. A process according to claim 1 wherein the winding filament is a mono-filament.

8. A process for the manufacture of a wrapped yarn which comprises continuously passing a bundle of stretched, highly oriented staple fibers longitudinally through the hollow shaft of a rotating bobbin carrying a filamentary yarn of 1 to 50 dtex, withdrawing the filamentary yarn from the bobbin and leading it to the longitudinally moving fiber bundle whereby rotation of the bobbin causes the fiber bundle to be wrapped with the filamentary yarn in a helical configuration, and limiting ballooning of the filament as it unwinds from the bobbin by means of a cylindrical retainer that rotates with the bobbin.

9. A process for the manufacture of a wrapped yarn which comprises the steps of passing a bundle of staple fibers longitudinally through the hollow shaft of a rotating bobbin that is internally wound with a filamentary yarn of 1 to 50 dtex, withdrawing said filamentary yarn from the interior of said bobbin at a tension of no more than 5 grams, and leading it to the longitudinally moving fiber bundle within the hollow shaft of the bobbin whereby rotation of the bobbin causes the fiber bundle to be wrapped with the filamentary yarn in a helical configuration.

* * * * *